United States Patent [19]

Zupancic

[11] 4,096,799

[45] Jun. 27, 1978

[54] BALER FOR LOOSE WIRE

[75] Inventor: Joseph Zupancic, Downey, Calif.

[73] Assignee: Weiner Steel Corporation, Pico Rivera, Calif.

[21] Appl. No.: 776,513

[22] Filed: Mar. 11, 1977

[51] Int. Cl.[2] ..... B30B 15/30

[52] U.S. Cl. ..... 100/215; 100/232; 100/249; 100/295

[58] Field of Search ..... 100/232, 215, 240, 249, 100/295

[56] References Cited

U.S. PATENT DOCUMENTS

| | | | |
|---|---|---|---|
| 1,110,283 | 9/1914 | Beaston | 100/249 X |
| 2,360,487 | 10/1944 | Fullerton | 100/215 X |
| 3,426,673 | 2/1969 | Miner | 100/232 X |
| 3,537,136 | 11/1970 | Solc | 100/215 |
| 3,654,854 | 4/1972 | Cook | 100/249 X |

*Primary Examiner*—Billy J. Wilhite
*Attorney, Agent, or Firm*—W. Edward Johansen

[57] ABSTRACT

The invention is an improved baler for baling loose wire which the baler receives from a loose wire loading device. The baler includes a mounting member, a hopper having an open base which is disposed adjacent to the first end of the mounting member and which is mounted on the top thereof and a cylindrical member having a pair of open ends and also having one-quarter of its sidewall removed therefrom to form an opening having a first edge and a second edge. The cylindrical member is disposed so that the opening has its first edge perpendicular to the top of the mounting member and its second edge parallel thereto and faces the second end of the mounting member. The baler also includes a first plate, having a first end and a second end and being disposed on the top of the mounting member and mechanically coupled so that the first plate slides reciprocally, horizontally thereon in such a manner that its first end enters the opening of the cylindrical member and contacts the oppositely disposed portion of the sidewall of the cylindrical member, and a first hydraulic system for horizontally pushing the first plate into the opening and retracting it therefrom. The baler further includes a second plate adapted to cover one of the open ends of the cylindrical member, a pair of parallel guide bars which are adapted to allow the second plate to slideably travel thereon adjacent to the open end, a second hydraulic system for driving the second plate along the pair of guide bars, a ram adapted to ram the baled wire from the other open end of the cylindrical member and mechanically coupled thereto and a third hydraulic system for driving the ram reciprocally in and out of the cylindrical member.

3 Claims, 6 Drawing Figures

BALER FOR LOOSE WIRE

BACKGROUND OF THE INVENTION

1. Field of the Invention

The present invention relates to an apparatus for processing scrap material and more particularly to a baler for compressing loose wire into compact blocks of scrap metal.

2. Description of the Prior Art

There are many patents which teach both apparatus and methods of compressing scrap metal and other scrap materials. Among these patents are U.S. Pat. Nos. 3,965,812, entitled Method of Compressing Scrap Metal, Gordon D. to GordonD. Oberg on June 29, 1976, 3,942,429, entitled Method and Apparatus for Forming Bales, issued to Roman Schmalz and Robert J. Wolf on Mar. 9, 1976, 3,999,476, entitled Closed Chamber Baler, issued to Wallace M. Thompson on Dec. 28, 1976, 4,002,115, entitled Double Baling Press, issued to Maurice Nanoia on Jan. 11, 1977, and 3,802,335, entitled System for Controlling the Hydraulic Ram of a Refuse Compactor, issued to Joseph F. Longo on Apr. 9, 1974.

U.S. Pat. No. 3,965,812 teaches an apparatus and method wherein relatively large bulky pieces of scrap metal can be, substantially and simultaneously divided into smaller pieces of scrap metal and then compressed into smaller and more dense units of scrap metal. U.S. Pat. No. 3,942,429 teaches a baling apparatus that includes a baling chamber and a compression ram mounted for reciprocal movement therein and a bale strapping chamber positioned adjacent to the baling chamber. U.S. Pat. No. 3,999,476 teaches a closed chamber baler which includes a hopper that is fed with compressible materials, a bale chamber, a device which transfers the compressible material from the hopper to the baling chamber and a compression device which compresses the compressible material within the baling chamber. U.S. Pat. No. 3,802,335 teaches a system for controlling the hydraulic ram of a refuse compactor in which a device actuates the forward movement of the ram to effect compacting and limiting the actuation to a first predefined time. The device also simultaneously senses the pressure in the system as a result of the compaction and on sensing of a predetermined level it limits the continued actuation to a second time period less than the first.

U.S. Pat. No. 3,273,493, entitled Apparatus for Processing Scrap Material, issued to Raymond J. Smiltneck on Sept. 20, 1966, teaches an apparatus for compressing and shearing junked automobiles. The apparatus includes a frame having a bed for receiving the scrap material to be processed, a shear member which is mounted on the frame, and a jaw member pivotally mounted on the frame and provided with a crushing portion at the outer end thereof and with a shear member mounted thereon between the crushing portion and the point at which the jaw is pivotally mounted on the frame. The shear and frame are adapted to produce a shearing action therebetween when the jaw is pivoted. The jaw crushes the scrap material on a particular stroke and shears off the crushed portion of the scrap material in the next stroke.

U.S. Pat. No. 3,279,297, entitled Coupling Means, also issued to Raymond J. Smiltneck on Oct. 18, 1966, teaches a load bearing coupling device for joining two members of a structure which is axially loaded in compression. The coupling device may be used in a ram-slide assembly of a power press.

U.S. Pat. No. 3,962,968, entitled Self-Closing Door for Baling Press, issued to Murray C. Tribbett and Nicholas L. Manko on June 15, 1976, teaches a baling press having separate loading and unloading openings near its opposite ends, a bolster which moves in the cavity to reduce the volume of the cavity and compress the material loaded therein to a predetermined size, a ram connected to reciprocate the bolster within the cavity between a retracted position clear of the loading opening and an advanced position beyond the loading opening, a door linked to a cooperating cam and follower devices mounted one to reciprocate with the ram and the other to control the motion of the door whereby movement of the bolster from its retracted position to its advanced position in a compression stroke will automatically close the door until the bolster returns to its retracted position.

U.S. Pat. No. 3,283,697, entitled Apparatus for Crushing and Processing Scrap Metals and Similar Scrap Materials, issued to George Allan Findlay on Nov. 8, 1966, teaches an apparatus which aligns the various pieces of scrap materials so that these pieces may be loaded in bending rather than loaded in axial compression while they are being compacted. The apparatus is presently used in most scrap metal yards to compress automobiles and automobile parts into blocks of scrap metal. The compression force generated by the ram-slide assembly in this apparatus is approximately 600 tons. U.S. Pat. No. 2,932,247, entitled Charging Box for Operating on Metal Scrap, issued to Wallace M. Thompson on Apr. 12, 1960, also teaches a compression device for forming briquettes of compressed metals out of scrap metal.

U.S. Pat. No. 3,426,673, entitled Method and Apparatus for Processing Waste Material, issued to William W. Miner and Lynn F. Johnson on Feb. 11, 1969, teaches a method of processing waste materials such as garbage and trash which includes the steps of controlling the flow of the waste material to a grinder, grinding the waste material into substantially smaller particles, transferring the particles to a compactor, and compacting the particles into a substance having a volume substantially less than the original volume of waste material.

U.S. Pat. No. 3,654,854, entitled Refuse Packer, issued to Kenneth L. Cook and Thomas R. McCartney on Apr. 11, 1972, teaches an automatic cycling refuse packer and its method of operation are provided. The packer includes an elongate receptacle with a discharge end and a gate operably attached to the discharge end for movement to and from closing and opening positions. A ram and hydraulic cylinder assembly is provided within the receptacle and controls axial movement of a ram plate extending transversely of the receptacle. Pressure actuated control means and an electrical control circuit control the automatic cycle of the ram for moving the ram plate towards the gate, raising the gate, moving the ram forwardly at a high pressure and ultimately retracting the ram and lowering the gate.

U.S. Pat. No. 3,537,136, entitled Apparatus for Briquetting Metal Chips, issued to Rudolph Solc on Nov. 3, 1970 teaches an apparatus for briquetting metal chips that includes a die member; a transverse channel passing through the die member, with the channel being open at both ends, an inlet opening in the die member arranged at an angle to the channel and communicating therewith. It also includes a feed duct for receiving the chips to be processed; a piston forming a punch member and being normally disposed in the transverse channel of the die, an abutment device for the piston; a device for supporting the piston for movement in the channel in a direction opposite to the abutment device, a ram movable into the path of movement of metal chips fed through the feed duct and inlet opening, whereby the chips are forced into the transverse channel and are pressed into a briquette chape between the piston and abutment device when the piston is moved against the abutment device, and a device for releasing the formed briquette from the channel.

None of the above-cited patents teach an apparatus which will compress a load of loose wire. One reason for this is that when loose wire is compressed by a large force it will attempt to spring back to its original density when the compressive force is removed. The scrap metal yardworkers generally ignore the accumulation of scrap loose wire in favor of the more easily baled larger pieces of scrap metals. The accumulation of loose wire is expensive for the scrap metal yard owner. Another reason for the absence of an apparatus to compress a load of loose wire is that loose wire is difficult to load into a conventional baling apparatus because of its relatively high bulk to weight ratio, i.e. the wire is all tangled up and takes up a larger amount of space relative to its weight than other forms of scrap metal.

SUMMARY OF THE INVENTION

In view of the foregoing factors and conditions of the prior art it is a primary object of the present invention to provide an improved baler for baling loose wire that does not require that the baled loose wires be secured by straps because the loose wires are rolled up within themselves.

It is another object of the present invention to provide an improved baler for baling loose wire that does not require as much hydraulic power as do other balers because the improved baler operates so that each bale of loose wire receives an accumulation of compression strokes.

It is still another object of the present invention to provide an improved baler for baling loose wire that has a hopper into which loose wire is easily loaded and which has a mechanism for transferring the loose wire into the compression cylinder of the improved baler.

It is yet another object of the present invention to provide an improved baler for baling loose wire which can efficiently and swiftly bale the mass of loose wire often found in a scrap metal yard.

In accordance with an embodiment of the present invention an improved baler for baling loose wire which the baler receives from a loose wire loading device has been described. The baler includes a mounting member, a hopper having an open base which is disposed adjacent to the first end of the mounting member and which is mounted on the top thereof and a cylindrical member having a pair of open ends and also having one-quarter of its sidewall removed therefrom to form an opening having a first edge and a second edge. The cylindrical member is disposed so that the opening has its first edge perpendicular to the top of the mounting member and its second edge parallel thereto and faces the second end of the mounting member. The baler also includes a first plate, having a first end and a second end and being disposed on top of the mounting member and mechanically coupled so that the first plate slides reciprocally, horizontally thereon in such a manner that its first end enters the opening of the cylindrical member and contacts the oppositely disposed portion of the sidewall of the cylindrical member, and a first hydraulic system for horizontally pushing the first plate into the opening and retracting it therefrom. The baler further includes a second plate adapted to cover one of the open ends of the cylindrical member, a pair of parallel guide bars which are adapted to allow the second plate to slideably travel thereon adjacent to the open end, a second hydraulic system for driving the second plate reciprocally along the pair of guide bars, a ram adapted to ram the baled wire from the other open end of the cylindrical member and mechanically coupled thereto and a third hydraulic system for driving the ram reciprocally in and out of the cylindrical member.

The features of the present invention which are believed to be novel are set forth with particularity in the appended claims.

Other objects and many of the attendant advantages of this invention will be more readily appreciated as the same becomes better understood by reference to the following detailed description and considered in connection with the accompanying drawing in which like reference symbols designate like parts throughout the figure.

DESCRIPTION OF THE PREFERRED EMBODIMENT

Figure 1:
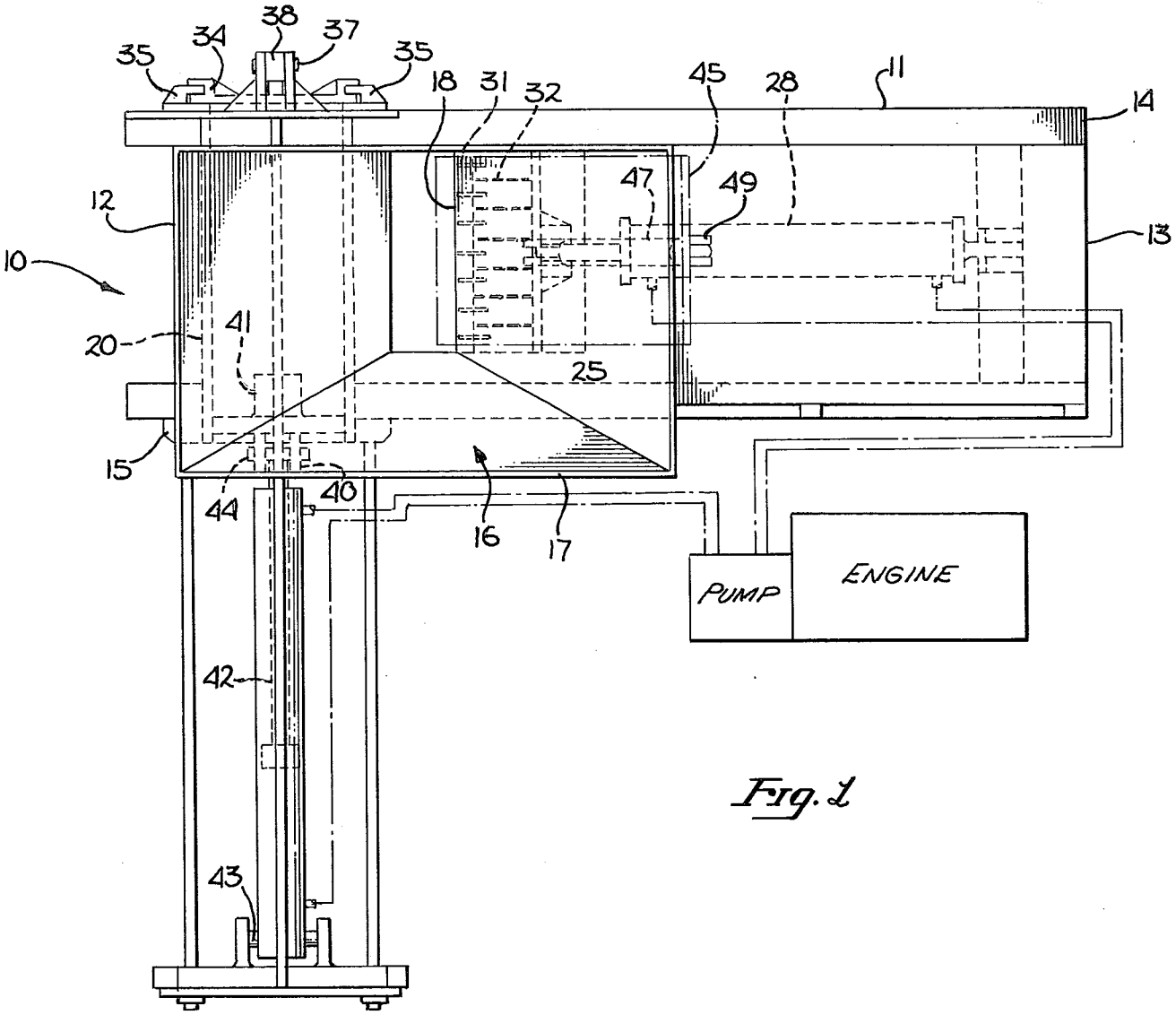
FIG. 1 is a plan view of an improved baler for baling loose wire which has been constructed in accordance with the present invention.

The present invention is an improved baler for baling loose wire which it receives from a loose wire loading device such as loading crane. The loose wire is generally stored in large piles in a scrap metal yard. The present invention can best be understood by reference to a description of its preferred embodiment in conjunction with the figures of the drawing. FIG. 1 is a plan view of an improved baler 10 that includes a frame 11 having a first end 12 and a second end 13, a top 14 and a base 15 and a hopper 16 having an open top 17, an open base 18 and four sidewalls and being mounted on the top 14 of the frame 11 adjacent to its first end 12. The improved baler 10 also includes a connector 19 which connects the open base 18 of the hopper 16 to the top 14 of the frame 11 and a cylindrical member 20 which has one-quarter of its sidewall removed to form an opening and having a first open end 21 and a second open end 22. The cylindrical member 20 is disposed on the top 14 of the frame 11 adjacent to both the connector 19 and the first end 12 of the frame 11 in such a manner that the opening has a first edge 23 perpendicular to the top 14 of the frame and a second edge 24 parallel to the top 14 of the frame 11. The opening faces the second end 13 of the frame 11.

Figure 2:
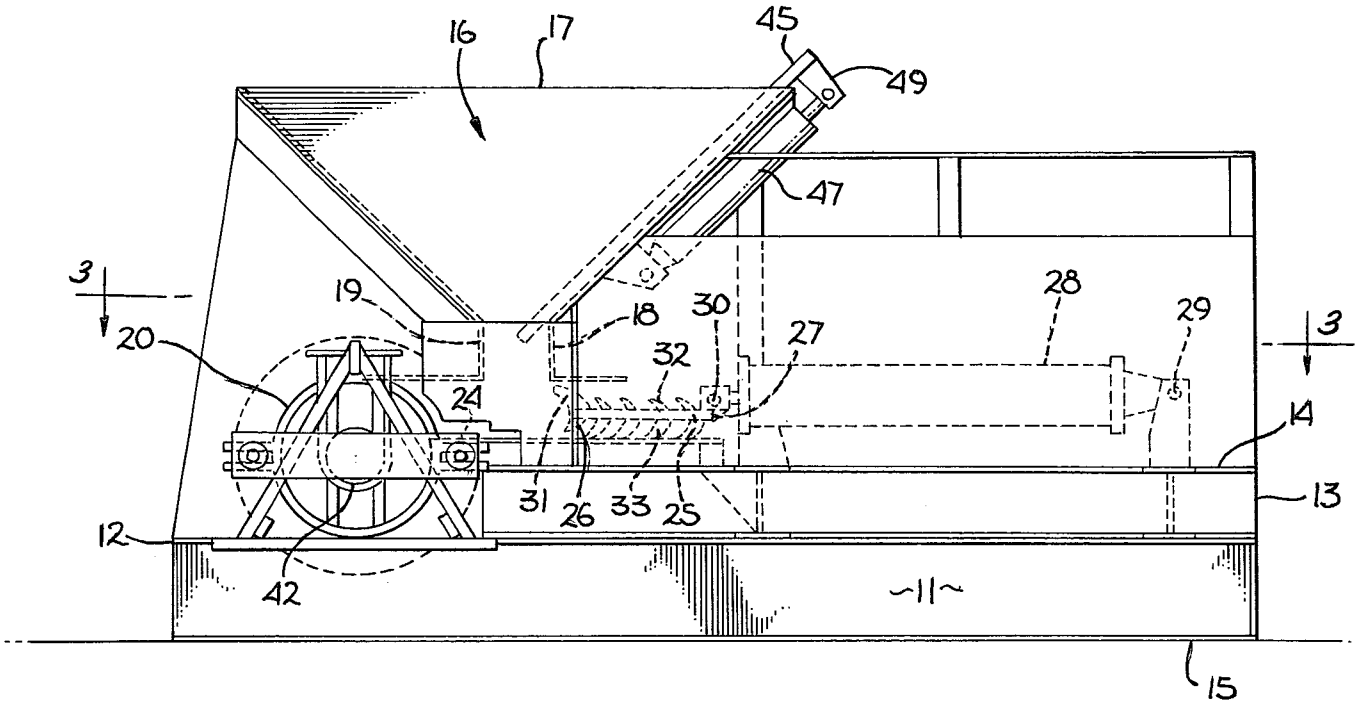
FIG. 2 is a side elevational view of the improved baler of FIG. 1.

In FIG. 2 the baler further includes a first plate 25 that a first end 26 and a second end 27, a hydraulic system that includes a pump, engine and a hydraulic cylinder 28, a coupling device 29 for coupling the hydraulic cylinder 28 to the frame 11 adjacent to its second end 13, and a coupling device 30 for coupling the first plate 25 to the hydraulic cylinder 28. The first plate 25 has a head 31 secured to its first end 26, top teeth 32 secured to its top surface and parallelly spaced to each other and bottom teeth 33 secured to its bottom surface and parallelly spaced to each other.

The first plate is mechanically coupled to the top 14 of the frame 11 so that it reciprocally slides horizontally thereon and so that it may enter the opening of the cylindrical member 20 between the first edge 23 and the second edge 24 and contact the oppositely disposed portion of the cylindrical member 20. The cylindrical member 20 is adapted to receive a heavy pounding in the range of 60 to 120 tons. In most baling devices the compression forces are in the range of 500 to 1000 tons, the uniqueness of the present invention is that several poundings of a smaller compressive force are used rather than one pounding of a larger compressive force. This adaption was made because loose wire when compacted still retains its springiness and will spring back to its original dimensions when the compressive force is removed. The present invention deforms a small amount of loose wire on each stroke and rolls the loose wire into a cylindrical roll.

Figure 3:
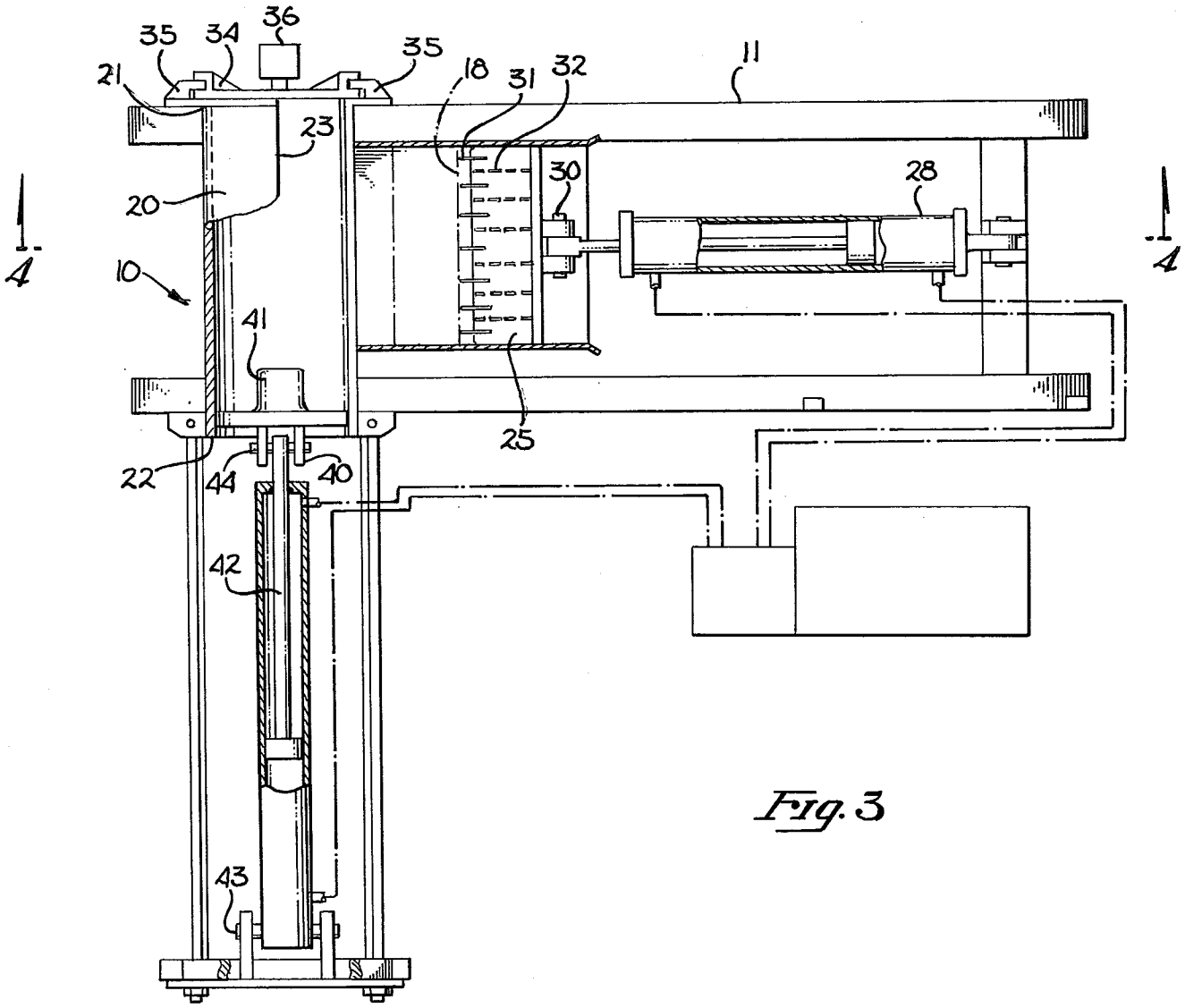
FIG. 3 is a top cross-sectional view of the baler of FIG. 1 taken along line 3—3 of FIG. 2.
Figure 4:
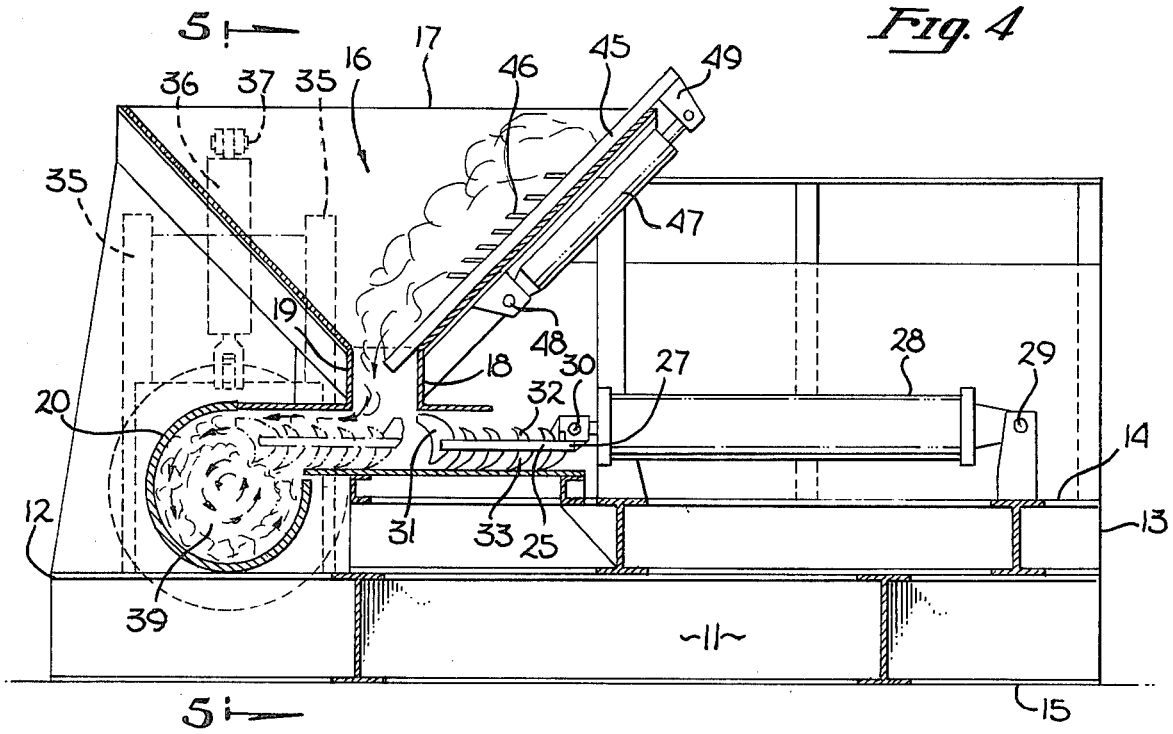
FIG. 4 is a side cross-sectional view of the baler of FIG. 1 taken along line 4—4 of FIG. 3.

Referring now to FIG. 3 the baler 10 also includes a second plate 34 which is disposed adjacent to the first open end 21 of the cylindrical member 20. Referring to FIG. 4 in conjunction with FIG. 3 and FIG. 5 the baler further includes a pair of parallel guide bars 35 which are adapted to allow the second plate 34 to reciprocally and slideably travel thereon and which are disposed perpendicular to the top 14 of the frame 11 and adjacent to the first end thereof and parallel to and adjacent to the first open end 21 of the cylindrical member 20. A second hydraulic cylinder 36 which receives its hydraulic power from the engine and pump is coupled mechanically to the frame 11 by a coupling device 37 and to the second plate 34 by another coupling device 38.

Figure 5:
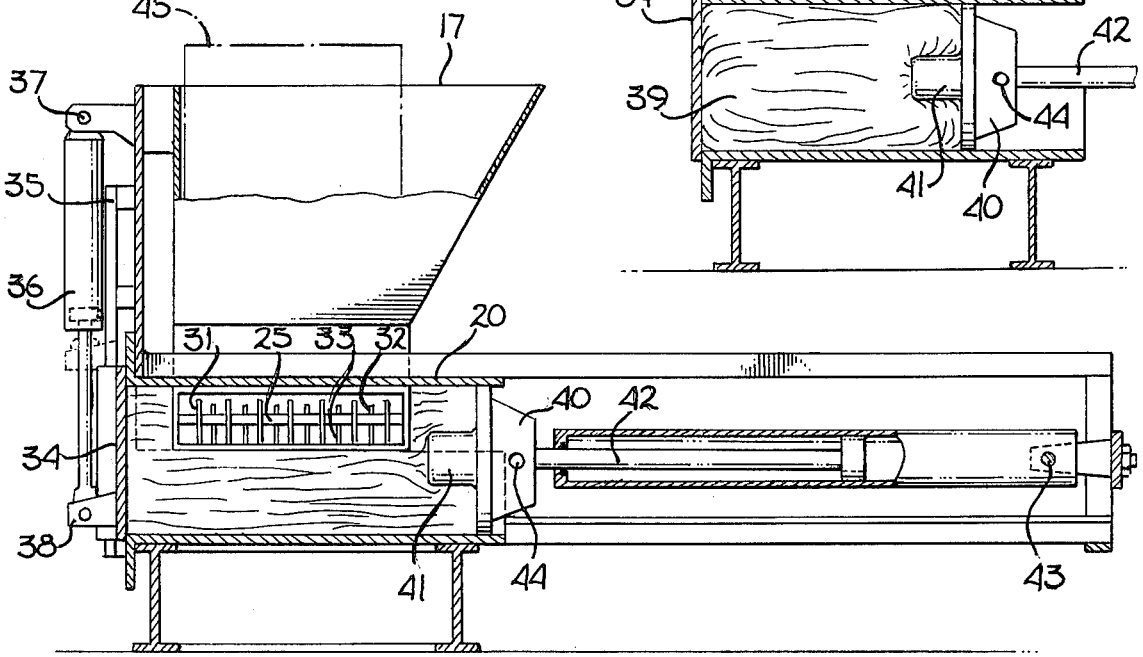
FIG. 5 is an end cross-sectional view of the baler of FIG. 1 taken along line 5—5 of FIG. 4.

The baler 10 in FIG. 4 is shown filled with loose wire 39 after it been rolled into a cylindrical roll. Referring now to FIG. 5 the improved baler 10 further includes a ram 40, having a cylindrical head 41, which is disposed adjacent to the second open end 22 of the cylindrical member 20 and perpendicular thereto, a hydraulic cylinder 42 which receives its hydraulic power from the engine and pump, a coupling device 43 for coupling the hyraulic cylinder 42 to the frame 11 and a coupling device 44 for coupling the ram 40 to the third hydraulic cylinder 42.

Figure 6:
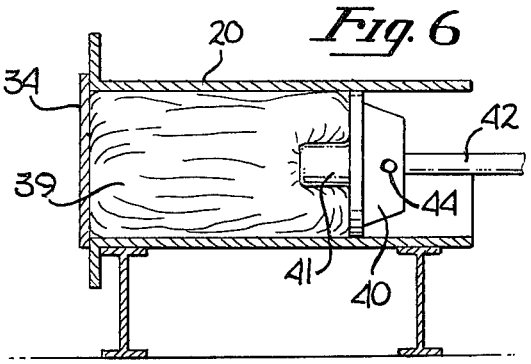
FIG. 6 is a side cross-sectional view of a ramming device of the baler of FIG. 1.

After the cylindrical roll of the baled loose wire 39 has been formed, the ram 40 is moved forward and crimps the end of the cylindrical roll of baled loose wire 39. After the baled loose wire 39 has been crimped, the ram 40 continues to move forward as the second plate 34 is hydraulically lifted thereby permitting the crimped cylindrical roll of baled loose wire to be pressed out of the cylindrical member 20 by the ram 40. The crimping of the cylindrical roll of the baled loose wire 39 is best shown in FIG. 6.

Referring again to FIG. 4 the improved baler 10 further includes a third plate 45 which is disposed on the inner surface of one of the four sidewalls of the hopper 16 and which is adapted to reciprocally slide parallelly to the sidewall, a set of teeth 46 secured to the top surface of the third plate 45 and disposed parallel to each other, a fourth hydraulic cylinder 47 that receives its hydraulic power from the engine and pump, a coupling device 48 for coupling the fourth cylinder 47 to the frame 11 and a coupling device 49 for coupling the third plate 45 to the fourth hydraulic cylinder 49.

From the foregoing it can be seen that an improved baler for baling loose wire has been described. The key element of the improved baler is cylindrical member which subjects the loose wire to a series of compressive forces from the first plate which gradually rolls the loose wire into a cylindrical roll.

It should be noted that the schematics of the improved baler has not been drawn to scale and that distances of and between figures are not to be considered significant.

Accordingly, it is intended that the foregoing disclosure and showing made in the drawing shall be considered only as illustrations of the principle of the present invention.

What is claimed is:

1. A baler for baling loose wire which said baler receives from a loose wire loading device, said baler comprising:

a. a mounting member having a top, a base, a first and a second end;

b. a hopper having an open top, an open base and four sidewalls, said base of said hopper being disposed adjacent to said first end of said mounting member and mounted to said top thereof;

c. a cylindrical member having a first open end and a second open end and also having one-quarter of its sidewall removed to form an opening, said cylindrical member being disposed on said top at said first end of said mounting member so that said opening has a first edge perpendicular to said top of said mounting member and a second edge parallel to said top of said mounting member and faces said second end of said mounting member and also being disposed adjacent to said base of said hopper so that loose wire may enter therein, and said cylindrical member being adapted to receive a heavy pounding;

d. a first plate having a first end and a second end, said plate being disposed on said top of said mounting member and being mechanically coupled to slide reciprocally, horizontally thereon so that its said first end enters said cylindrical member between its said first and second edges and contacts the oppositely disposed portion of said cylindrical member;

e. hydraulic means for reciprocally driving said first plate, mechanically coupled to said mounting member.

2. A baler for baling loose wire which said baler receives from a loose wire loading device according to claim 1, wherein said baler also comprises:

a. a second plate adapted to cover said first open end of said cylindrical member;

b. a pair of parallel guide bars which are adapted to allow said second plate to reciprocally and slideably travel thereon, said parallel bars being disposed perpendicular to said top of said mounting member and adjacent to said first end thereof and parallel to and adjacent to said first open end of said cylindrical member;

c. second hydraulic means for reciprocally driving said second plate upwardly and downwardly along said pair of parallel bars;

d. ramming means for ramming the baled wire, said ramming means being disposed at said second end of said cylindrical member and mechanically coupled thereto; and e. third hydraulic means for reciprocally driving said ramming means inwardly and outwardly.

3. A baler for baling loose wire which said baler receives from a loose wire loading device according to claim 2, wherein said baler further comprises:

a. a third plate having a first end and a second end, said plate being disposed on an inner surface of one of said four sidewalls of said hopper and being adapted to reciprocally slide parallelly to said sidewall thereby forcing the loose wire out of said open base of said hopper into said opening of said cylindrical member; and b. a fourth hydraulic means for reciprocally driving said third plate in its slideable movement, coupled mechanically to said second end of said third plate.

* * * * *